US005613480A

United States Patent [19]

Katoh et al.

[11] Patent Number: 5,613,480

[45] Date of Patent: Mar. 25, 1997

[54] FUEL CONTROL SYSTEM FOR MULTIPLE CYLINDER ENGINE

[75] Inventors: Masahiko Katoh; Kimihiro Nonaka; Kazuhiro Nakamura, all of Hamamatsu, Japan

[73] Assignee: Sanshin Kogyo Kabushiki Kaisha, Hamamatsu, Japan

[21] Appl. No.: 476,089

[22] Filed: Jun. 7, 1995

[30] Foreign Application Priority Data

Jun. 24, 1994 [JP] Japan ..... 6-143668

[51] Int. Cl.[6] ..... F02D 41/14

[52] U.S. Cl. ..... 123/673; 123/681

[58] Field of Search ..... 123/435, 673, 123/681, 703

[56] References Cited

U.S. PATENT DOCUMENTS

| | | | |
|---|---|---|---|
| 4,483,300 | 11/1984 | Hosaka et al. | 123/673 |
| 4,831,820 | 5/1989 | Lassanske | 60/276 |
| 4,903,648 | 2/1990 | Lassankse | 123/65 R |
| 4,903,665 | 2/1990 | Washino et al. | 123/435 |
| 4,919,099 | 4/1990 | Extance et al. | 123/435 X |
| 5,020,502 | 6/1991 | Wild | 123/673 |
| 5,377,654 | 1/1995 | LoRusso et al. | 123/673 |

FOREIGN PATENT DOCUMENTS

| | | | |
|---|---|---|---|
| 57-102529 | 6/1982 | Japan | 123/673 |

*Primary Examiner*—Tony M. Argenbright
*Attorney, Agent, or Firm*—Knobbe, Martens, Olson & Bear, LLP

[57] ABSTRACT

A feedback control system for a multi-cylinder engine using a combustion condition sensor that senses the condition in only one cylinder. The total air flow to the engine is measured and the amount of fuel supplied to other than the sensed cylinders is varied in response to known variations in air flow for a given engine running conditions. The sense cylinder has direct feedback control with no correction.

12 Claims, 6 Drawing Sheets

FUEL CONTROL SYSTEM FOR MULTIPLE CYLINDER ENGINE

BACKGROUND OF THE INVENTION

This invention relates to a fuel control system for a multiple cylinder engine and more particularly to an improved feedback control system for such engines.

It has been acknowledged that feedback control systems are very effective in controlling not only the fuel economy but also the exhaust emission of internal combustion engines. One type of control that operates on a feedback principle employs an exhaust combustion sensor in the exhaust system for sensing the air/fuel ratio. The air/fuel ratio is then adjusted in response to the output of this sensor so as to maintain the desired fuel/air ratio.

Such systems, although capable of use with four-cycle engines, do present certain problems when utilized with two-cycle engines. The reason for this is that two-cycle engines frequently employ a large degree of scavenging and hence the exhaust gases may not be truly representative of the combustion characteristics at the completion of the combustion cycle. That is, the combustion products may be diluted with a fresh charge and hence feedback control is difficult.

There has, therefore, been proposed a system wherein a sensor is positioned and related to a single cylinder of a multiple cylinder engine and which senses the combustion products in that cylinder only at the time when combustion has been substantially completed and before any significant scavenging has occurred. These systems are very effective.

However, if only a single sensor is employed for controlling all cylinders, then the cylinder-to-cylinder variations can be significant. For example, in outboard motors it is the common practice to employ an exhaust manifold that collects all of the exhaust gases from all of the cylinders and which discharges it to the atmosphere. Because of the fact that the exhaust-pipe exit is spaced at different distances from the individual exhaust ports and because of the pulse-back effect, there can be wide cylinder-to-cylinder variations. In addition, the variations between cylinders is not the same under various running conditions.

This problem can be accommodated by providing an independent sensor for each cylinder of the engine. That obviously provides a very complicated and expensive solution to the problem.

It is, therefore, a principle object of this invention to provide an improved feedback control system for a multiple cylinder engine wherein one sensor is employed for controlling all cylinders.

It is a further object of this invention to provide a single sensor feedback control system for an engine wherein cylinder-to-cylinder variations are automatically accommodated for.

SUMMARY OF THE INVENTION

This invention is adapted to be embodied in an internal combustion engine having a plurality of combustion chambers. A charge-forming and induction system is provided for delivering a fuel/air mixture to each of the combustion chambers. An exhaust system is provided for collecting the exhaust gases from the combustion chambers and discharging them to the atmosphere. A combustion condition sensor is provided for sensing the combustion condition in only one of the combustion chambers. An air-flow meter is provided for sensing the air flow to all of the combustion chambers.

In accordance with an apparatus for practicing the invention, the feedback control of the one combustion chamber is controlled by the output of the combustion condition sensor while the control for the remaining combustion chamber is adjusted in response to the air flow to the engine and the known variations from combustion chamber to combustion chamber for given air flows.

In accordance with a method for practicing the invention, the total air flow to all combustion chambers is measured. The one combustion chamber has its fuel/air ratio controlled by direct feedback control from the output of the combustion condition sensor. The control of the remaining combustion chambers is varied in proportion to the air flow to those cylinders as predetermined from the total air flow to compensation for cylinder-to-cylinder variations.

DETAILED DESCRIPTION OF THE PREFERRED EMBODIMENT OF THE INVENTION

Figure 1:
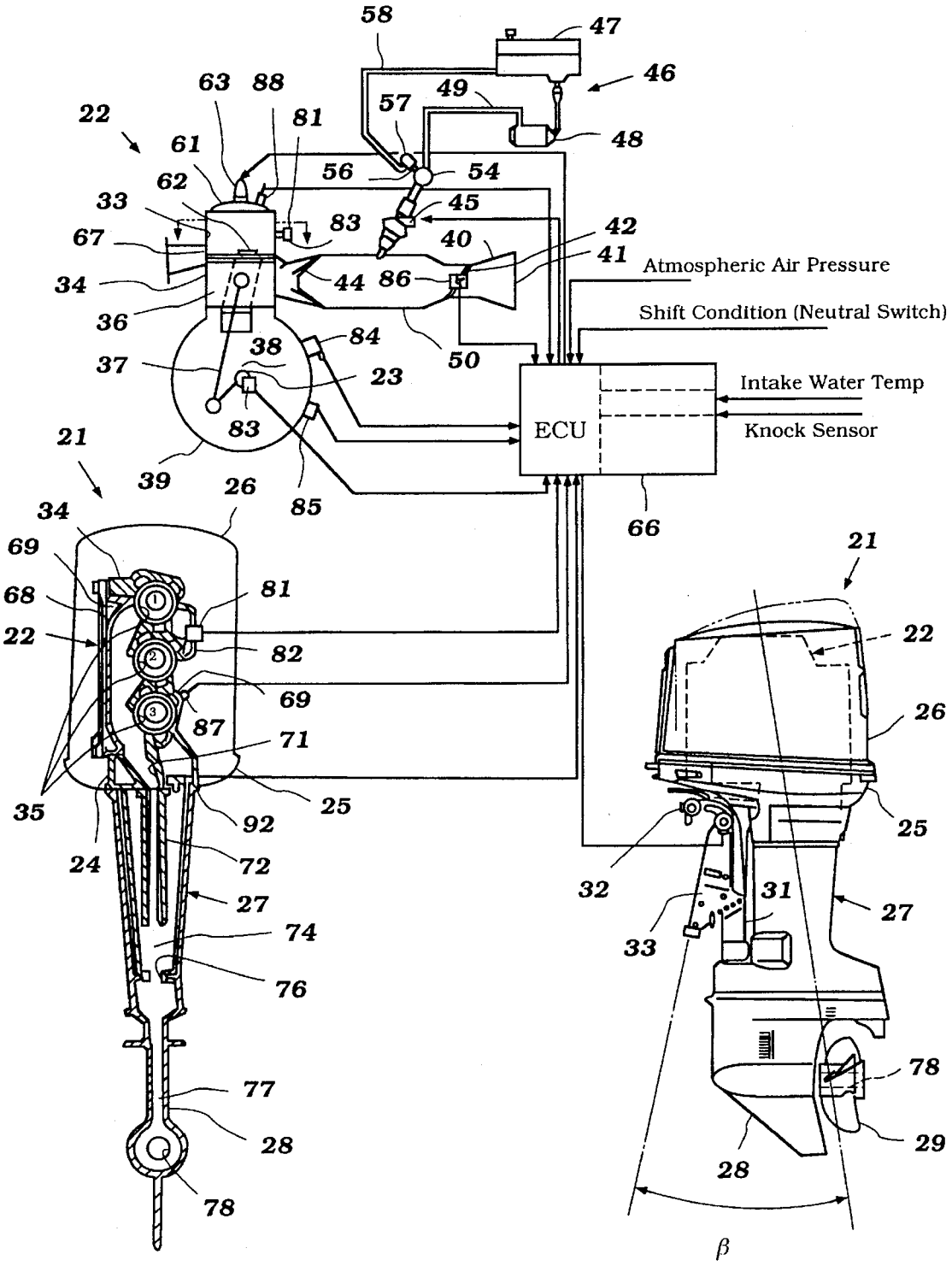
FIG. 1 is a three-part view showing an outboard motor constructed in accordance with an embodiment of the invention and side elevational view in the lower right-hand side, a cross-sectional view taken along a generally vertically extending plane on the lower left-hand side view and a schematic horizontal cross-sectional view through one cylinder of the engine and showing the control system and control elements partially in schematic form.

Referring now in detail to the drawings, and initially to FIG. 1, an outboard motor is shown in the lower portion of this figure in rear cross section and side elevation and is indicated generally by the reference numeral 21. The invention is shown in conjunction with an outboard motor because the invention has particular utility in conjunction with two-cycle crankcase compression engines. Such engines are normally used as the propulsion device for outboard motors. For these reasons, the full details of the outboard motor 21 will not be described and have not been illustrated. Those skilled in the art can readily understand how the invention can be utilized with any known type of outboard motor.

The outboard motor 21 includes a power head that is comprised of a powering internal combustion engine, indicated generally by the reference numeral 22. The engine 22 is shown in the lower view of FIG. 1, with a portion broken away, and in a schematic cross-sectional view through a single cylinder in the upper view of this figure. The construction of the engine 22 will be described later, but it should be noted that the engine 22 is mounted in the power head so that its crankshaft, indicated by the reference numeral 23, rotates about a vertically extending axis. The engine 22 is mounted on a guide plate 24 provided at the lower end of the power head and the upper end of a drive shaft housing, to be described. Finally, the power head is completed by a protective cowling comprised of a lower tray portion 25 and a detachable upper main cowling portion 26.

The engine crankshaft 23 is coupled to a drive shaft (not shown) that depends into and is rotatably journaled within the aforenoted drive shaft housing which is indicated by the reference numeral 27. This drive shaft then continues on to drive a forward/neutral/reverse transmission, which is not shown but which is contained within a lower unit 28. This transmission provides final drive to a propeller 29 in any known manner for propelling an associated watercraft.

A steering shaft (not shown) is affixed to the drive shaft housing 27. This steering shaft is journaled for steering movement within a swivel bracket 31 for steering of the outboard motor 21 and the associated watercraft (not shown) in a well-known manner. The swivel bracket 31 is, in turn, pivotally connected by a pivot pin 32 to a clamping bracket 33. The clamping bracket 33 is adapted to be detachably affixed to the transom of the associated watercraft. The pivotal movement about the pivot pin 32 accommodates trim and tilt-up operation of the outboard motor 21, as is well known in this art.

Continuing to refer to FIG. 1 and now primarily to the lower left-hand side view and the upper view, the engine 22 is depicted as being of the two-cycle crankcase compression type and, in the specific illustrated embodiment, is of a three-cylinder in-line configuration. Although this particular cylinder configuration is illustrated, it will be apparent to those skilled in the art how the invention may be employed with engines having other numbers of cylinders and other cylinder orientations. In fact, certain facets of the invention may also be employed with rotary or other ported type engines.

The engine 22 includes a cylinder block 34 in which three cylinder bores 35 are formed. Pistons 36 reciprocate in these cylinder bores 35 and are connected by means of connecting rods 37 to the crankshaft 23. The crankshaft 23 is, in turn, journaled for rotation within a crankcase chamber 38 in a suitable manner. The crankcase chamber 38 is formed by the cylinder block 34 and a crankcase member 39 that is affixed to it in any known manner.

As is typical with two-cycle crankcase compression engine practice, the crankcase chambers 38 associated with each of the cylinder bores 35 are sealed relative to each other in an appropriate manner. A fuel-air charge is delivered to each of the crankcase chambers 28 by an induction system which is comprised of an atmospheric air inlet device 40 which draws atmospheric air through an inlet 41 from within the protective cowling. This air is admitted to the protective cowling in any suitable manner.

A throttle body assembly 42 is positioned in an intake manifold 50 downstream of the air inlet 41 and is operated in any known manner. Finally, the intake system discharges into intake ports 43 formed in the crankcase member 39. Reed-type check valves 44 are provided in each intake port 43 for permitting the charge to be admitted to the crankcase chambers 38 when the pistons 36 are moving upwardly in the cylinder bore 35. These reed-type check valves 44 close when the piston 36 moves downwardly to compress the charge in the crankcase chambers 38, as is also well known in this art.

Fuel is added to the air charge inducted into the crankcase chambers 38 by a suitable charge former. In the illustrated embodiment, this charge former includes fuel injectors 45, each mounted in a respective branch of the intake manifold downstream of the respective throttle valve 42. The fuel injectors 45 are preferably of the electronically operated type. That is, they are provided with an electric solenoid that operates an injector valve so as to open and close and deliver high-pressure fuel directed toward the intake port 43.

Fuel is supplied to the fuel injectors 45 under high pressure through a fuel supply system, indicated generally by the reference numeral 46. This fuel supply system 46 includes a fuel tank 47 which is positioned remotely from the outboard motor 21 and preferably within the hull of the watercraft propelled by the outboard motor 21. Fuel is pumped from the fuel tank 47 by means of a fuel pump 48, which may be electrically or otherwise operated. This fuel then passes through a fuel filter, which preferably is mounted within the power head of the outboard motor 21. Fuel flows from the fuel filter through a conduit 49 to a high-pressure fuel pump which is driven in any known manner as by an electric motor or directly from the engine 22. This fuel pump delivers fuel under high pressure to a fuel rail 59 through a conduit. The fuel rail 54 serves each of the injectors 45 associated with the engine.

A return conduit 56 extends from the fuel rail 54 to a pressure regulator 57. The pressure regulator 57 controls the maximum pressure in the fuel rail 54 that is supplied to the fuel injectors 45. This is done by dumping excess fuel back to the fuel supply system through a return line 58 for example back to the fuel tank 47.

The fuel-air charge which is formed by the charge-forming and induction system as thus far described is transferred from the crankcase chambers 38 to combustion chambers, indicated generally by the reference numeral 59, of the engine. These combustion chambers 59 are formed by the heads of the pistons 36, the cylinder bores 35, and a cylinder head assembly 61 that is affixed to the cylinder block 34 in any known manner. The charge so formed is transferred to the combustion chamber 59 from the crankcase chambers 38 through one or more scavenge passages 62.

Spark plugs 63 are mounted in the cylinder head 61 and have their spark gaps extending into the combustion chambers 59. The spark plugs 63 are fired by a capacitor discharge ignition system (not shown). This outputs a signal to a spark coil which may be mounted on each spark plug 63 for firing the spark plug 63 in a known manner.

The capacitor discharge ignition circuit is operated, along with certain other engine controls by an engine management ECU, shown schematically and identified generally by the reference numeral 66.

When the spark plugs 63 fire, the charge in the combustion chambers 59 will ignite and expand so as to drive the pistons 36 downwardly. The combustion products are then discharged through exhaust ports 67 formed in the cylinder block 34. These exhaust gases then flow through an exhaust manifold identified by the reference numeral 68. The exhaust gases then pass downwardly through an opening in the guide plate 24 to an appropriate exhaust system (in the drive shaft housing 27) for discharge of the exhaust gases to the atmosphere. Conventionally, the exhaust gases are discharged through a high-speed under-the-water discharge and a low-speed, above-the-water discharge. The systems may be of any type known in the art.

The engine 22 is water cooled, and for this reason, the cylinder block 34 is formed with a cooling jacket 69 to which water is delivered from the body of water in which the watercraft is operating. Normally, this coolant is drawn in through the lower unit 28 by a water pump positioned at the interface between the lower unit 28 and the drive shaft housing 27 and driven by the drive shaft. This coolant also circulates through a cooling jacket formed in the cylinder head 61. After the water has been circulated through the engine cooling jackets, it is dumped back into the body of water in which the watercraft is operating. This is done in any known manner and may involve the mixing of the coolant with the engine exhaust gases to assist in their silencing. This will also be described later.

The exhaust system for discharging the exhaust gases to the atmosphere will be described. As has been noted, the exhaust manifold 68 communicates with an exhaust passage, indicated by the reference numeral 71, that is formed in the spacer or guide plate 24. An exhaust pipe 72 is affixed to the lower end of the guide plate 24 and receives the exhaust gases from the passage 71.

The exhaust pipe 72 depends into an expansion chamber 74 formed within the outer shell of the drive shaft housing 27. This expansion chamber 74 is defined by an inner member which has a lower discharge opening 76 that communicates with an exhaust chamber 77 formed in the lower unit 28 and to which the exhaust gases flow.

A through-the-hub, high speed, exhaust gas discharge opening 78 is formed in the hub of the propeller 29 and the exhaust gases exit the outboard motor 22 through this opening below the level of water in which the watercraft is operating when traveling at high speeds. In addition to this high speed exhaust gas discharge, the outboard motor 21 may be provided with a further above-the-water, low speed, exhaust gas discharge (not shown). As is well know in this art, this above-the-water exhaust gas discharge is relatively restricted, but permits the exhaust gases to exit without significant back pressure when the watercraft is traveling at a low rate of speed or is idling, and the through-the-hub exhaust gas discharge 78 will be deeply submerged.

It has been noted that the ECU 66 controls the capacitor discharge ignition circuit and the firing of the spark plugs 63. In addition, the ECU controls the fuel injectors 45 so as to control both the beginning and duration of fuel injection and the regulated fuel pressure, as already noted. The ECU 66 may operate on any known strategy for the spark control and fuel injection control 45, although this system employs an exhaust sensor assembly indicated generally by the reference numeral 81 constructed in accordance with any of the embodiments of the copending application of Masahiko Katoh, Serial No. 08/435,715, filed May 5, 1995, which application is assigned to the assignee hereof, the disclosure of which is incorporated herein by reference. Specifically, the embodiment illustrated here embodies the same sensor construction as shown in FIGS. 1–10 of that copending application. Since the invention in this application deals primarily with the control system rather than the construction of the sensor, the sensor per se will not be described in detail. However, the principal of operation of the sensor will be described later when the mode of operation of the preferred embodiment of this invention is described.

The sensor 81 is positioned in a conduit 82 that is interconnected between two of the cylinders (cylinders 1 and 2 in the illustrated embodiment) for a reason which will also be described later.

So as to permit engine management, a number of additional sensors are employed. Some of these sensors are illustrated either schematically or in actual form, and others are not illustrated. It should be apparent to those skilled in the art, however, how the invention can be practiced with a wide variety of control strategies other than or in combination with those which form the invention.

The sensors as shown schematically in FIG. 1 include a crankshaft position sensor 83 which senses the angular position of the crankshaft 23 and also the speed of its rotation. A crankcase pressure sensor 84 is also provided for sensing the pressure in the individual crankcase chambers 38. Among other things, this crankcase pressure signal may be employed as a means for measuring intake air flow and, accordingly, controlling the amount of fuel injected by the injector 45, as well as its timing.

A temperature sensor 85 may be provided in the crankcase chamber 38 for sensing the temperature of the intake air. In addition, the position of the throttle valve 42 is sensed by a throttle position sensor 86. Engine temperature is sensed by a coolant temperature sensor 87 that is mounted in an appropriate area in the engine cooling jacket 69. An in-cylinder pressure sensor 88 may be mounted in the cylinder head 61 so as to sense the pressure in the combustion chamber 59.

Other sensors which are not shown but their outposts to the ECU are noted in FIG. 1 include a knock sensor may also be mounted in the cylinder block 34 for sensing the existence of a knocking condition. Certain ambient conditions also may be sensed, such as atmospheric air pressure, intake cooling water temperature, this temperature being the temperature of the water that is drawn into the cooling system before it has entered the engine cooling jacket 69.

In accordance with some portions of the control strategy, it may also be desirable to be able to sense the condition of the transmission for driving the propeller 29 or at least when it is shifted into or out of neutral. Thus, a transmission condition sensor is mounted in the power head and cooperates with the shift control mechanism for providing the appropriate indication as indicated schematically.

Furthermore, a trim angle sensor 91 is provided for sensing the angular position of the swivel bracket 31 relative to the clamping bracket 33 and the trim angle $\beta$ of the outboard motor 21.

Finally, the engine exhaust gas back pressure is sensed by a back pressure sensor that is positioned within the expansion chamber 74 which forms part of the exhaust system for the engine and which is positioned in the drive shaft housing 27.

Figure 2:
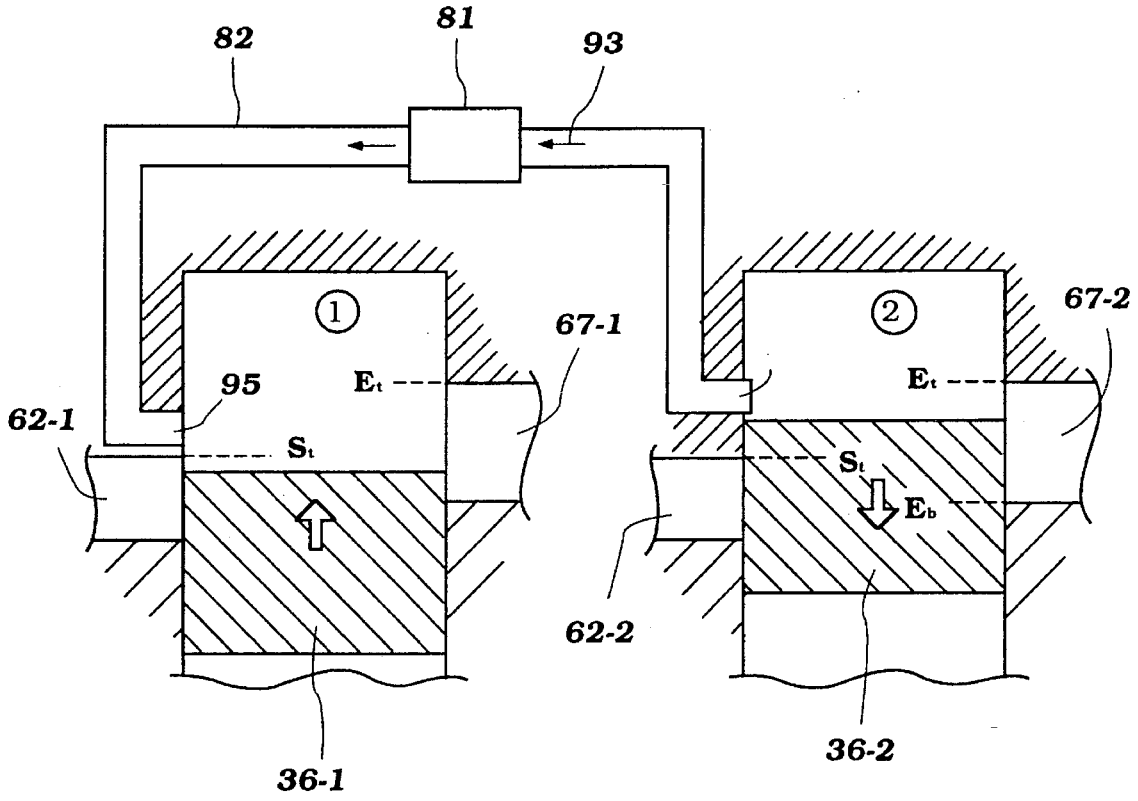
FIG. 2 is an enlarged schematic cross-sectional view taken through two cylinders of the engine and showing the connection of the exhaust sensor thereto.

The way in which the exhaust sensor 81 operates so as to sample the combustion products from one of the cylinders at the end of the combustion cycle without being diluted with incoming charge is described in more detail in the aforenoted copending application but the theory will be described by particular reference to FIGS. 2 and 3 since they indicate how the system provides good sampling and undiluted sampling so that the exhaust sensor 81, which as has been noted is an $O_2$ sensor, can provide good feedback control.

Basically, the theory of operation is that the conduit 82 that supplies the sample of combustion products to the sensor 81 is interconnected between two cylinders that are out of phase with each other. In the illustrated embodiment, these are the cylinders 1 and 2 numbering the cylinders from the top and wherein cylinder 2 is the active cylinder from which the combustion products are sampled. Cylinder 1 acts, in effect, as a valve to control the direction of flow so that it is generally in the direction of the arrows 93 shown in FIG. 2 so that the combustion products from cylinder 2 are sampled and also they are sampled at a point at the end of the combustion cycle.

Basically, the conduit 82 has a port opening 94 into cylinder 2 at a point that is approximately equal to the point when the exhaust port 67-2 is open ($E_t$). This is at a time when the combustion in cylinder 2 is substantially completed and the exhaust port will open so that the exhaust gases can flow out of the exhaust port 67-2. As may be seen in FIG. 3, which is a pressure trace of the cylinder pressures with the cylinder 2 pressure being indicated at P2 and the pressure in cylinder 1 being indicated at P1. It will be seen that when the piston 36-2 sweeps across the port 94 the pressure in the combustion chamber of cylinder 2 will have been falling because the gases have been burning and expanding. At the point in time when the exhaust port opens the pressure will continue to be dropping but it will still be greater than the atmospheric pressure indicated at the value 1 in FIG. 3.

The conduit 82 also has a port opening 95 which communicates with cylinder 1 but this port opening is disposed to be immediately adjacent the point when the scavenge port 62-1 of cylinder 1 is closed by the upward movement of the piston 36-1. Hence, there will be a positive flow from the cylinder 2 to the cylinder 1 through the sensor 81 and conduit 82 at this time period. At this point in time, cylinder 1 will have its pressure generally at atmospheric pressure because the charge which has been compressed in the crankcase chamber and is transferred to the combustion chamber will not have undergone any further pressure in the cylinder 1. Hence, the flow is in the direction of the arrow 93.

As may be seen, when the piston 36-2 continues to move downwardly eventually the scavenge port 62-2 will open and then the diluting charge will enter the combustion chamber of cylinder 2. However, by this time the port 95 in cylinder 1 will have been closed and hence no flow can occur through the conduit 82 and the sensor 81 will only receive final combustion products from cylinder 2 at the end of the cycle.

Figure 3:
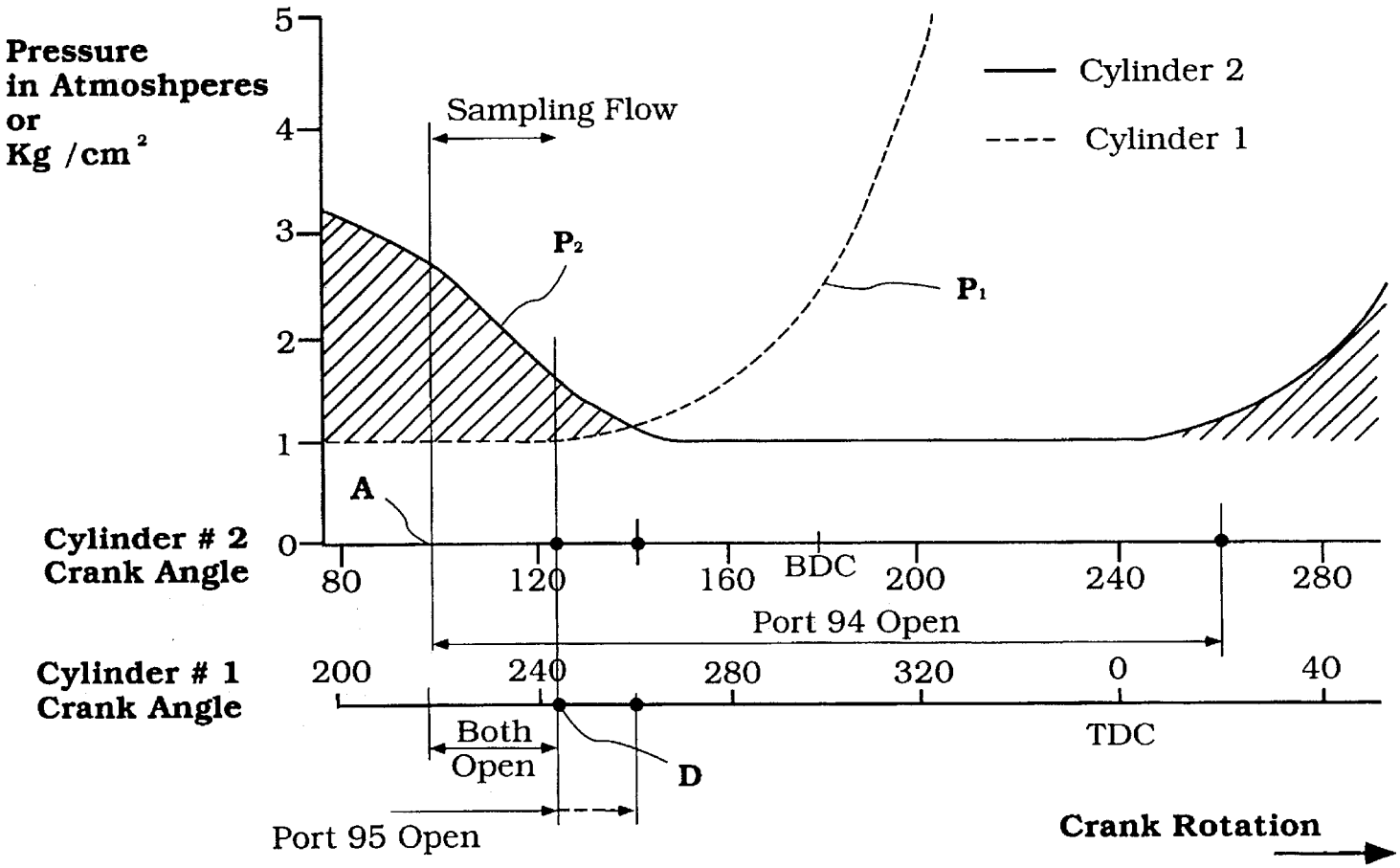
FIG. 3 is a graphical view showing the relationship of the pressure in the various cylinders and to illustrate how the exhaust sampling is controlled.

The sampling time is as indicated on the timing diagram of FIG. 3 and this being basically the time when both ports 94 and 95 are open. In fact, when port 95 is closed and port 94 is still open, the pressure in the conduit 82 will be higher than the pressure in the cylinder 2 and hence there will actually be some purging of the accumulator chamber containing the sensor 81 back into the cylinder 2 so that the sensor 81 always receives a fresh charge of combustion products for each cycle.

Because the port opening 94 of the conduit 82 in cylinder 2 is higher in the cylinder bore than the port opening 95 in cylinder 1, port opening 94 will be open for a longer period of time than will the opening of port 95. These respective timings are indicated in the distance between the points A and D in FIG. 3 and this is the time when the actual sampling will occur.

Figure 4:
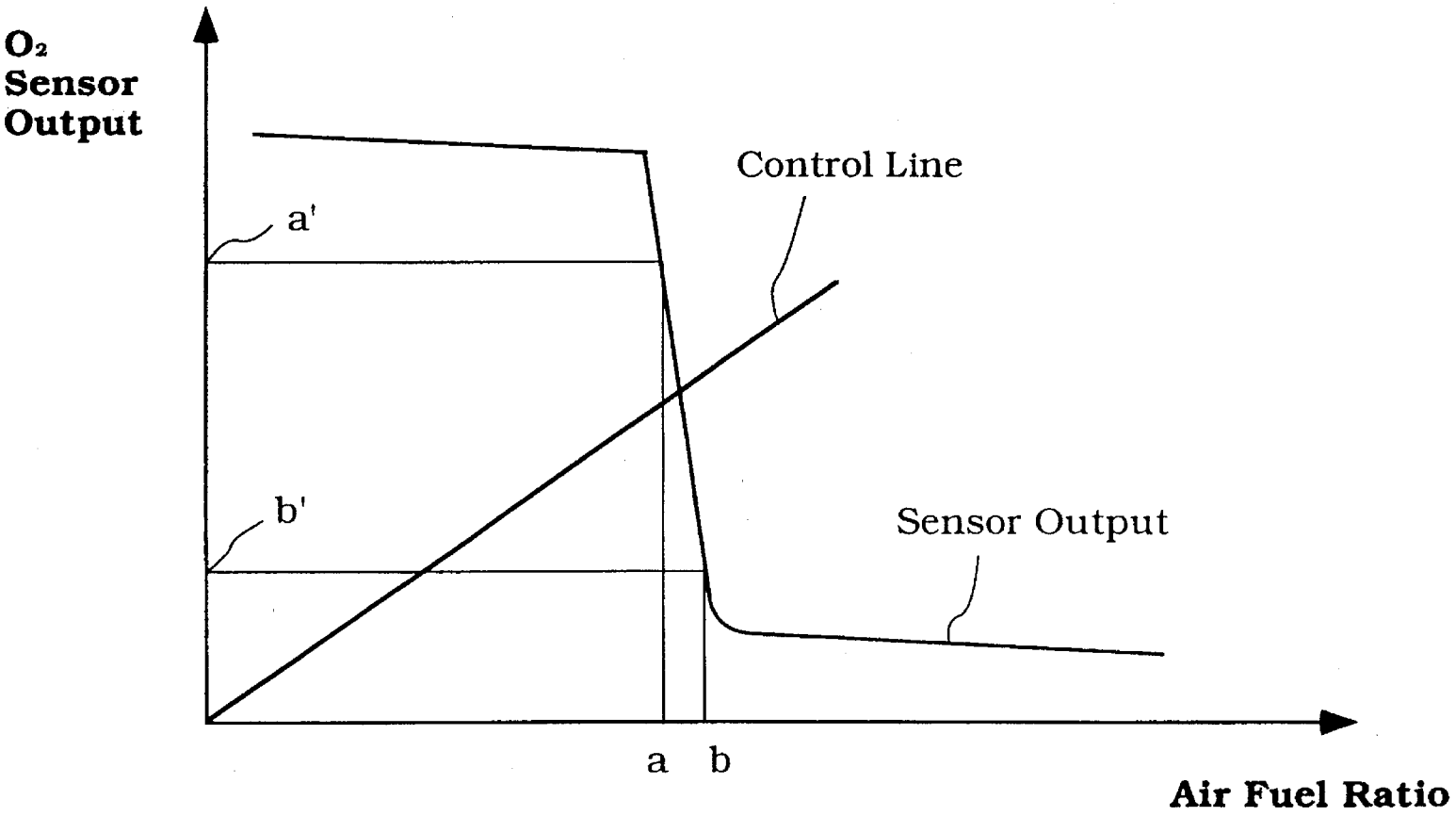
FIG. 4 is a graphical view showing the output of an oxygen sensor in relation to air/fuel ratio and the control range applied.

As is well known, sensors like the oxygen sensor 81, although they are very useful in providing an indication of mixture strength for feedback control, are basically on/off devices. FIG. 4 shows the sensor output curve and how the sensor output varies significantly in a very small range relative to the actual change in air/fuel ratio. Therefore, it is desirable to operate on the control line indicated in this figure in the range a–b/a'b' so as to provide the control.

From the foregoing description it should be readily apparent that the described system provides very accurate measurement of the actual combustion conditions in the cylinder which communicates with the oxygen sensor 81. As has been noted, however, the fact that the individual exhaust port 67 of the individual cylinders are spaced at different ends from the end of the exhaust pipe 72, the actual running conditions in the individual cylinders will vary. Thus, if the output from the sensor 81 is employed for controlling the fuel supply to each cylinder by its respective fuel injector 45 there will be a variation in actual mixture strengths in the cylinders.

Therefore, and in accordance with an important feature of the invention, the ECU 66 is programmed so as to provide a variation in the amount of fuel supplied to each cylinder by its fuel injector 45 in response to known variables between the cylinders. The basic overall control strategy may be of any desired type such as that described in the aforenoted copending application. However, the cylinder-to-cylinder variation is accommodated by a routine and structure as may be best understood by reference to FIGS. 5 and 6.

Figure 5:
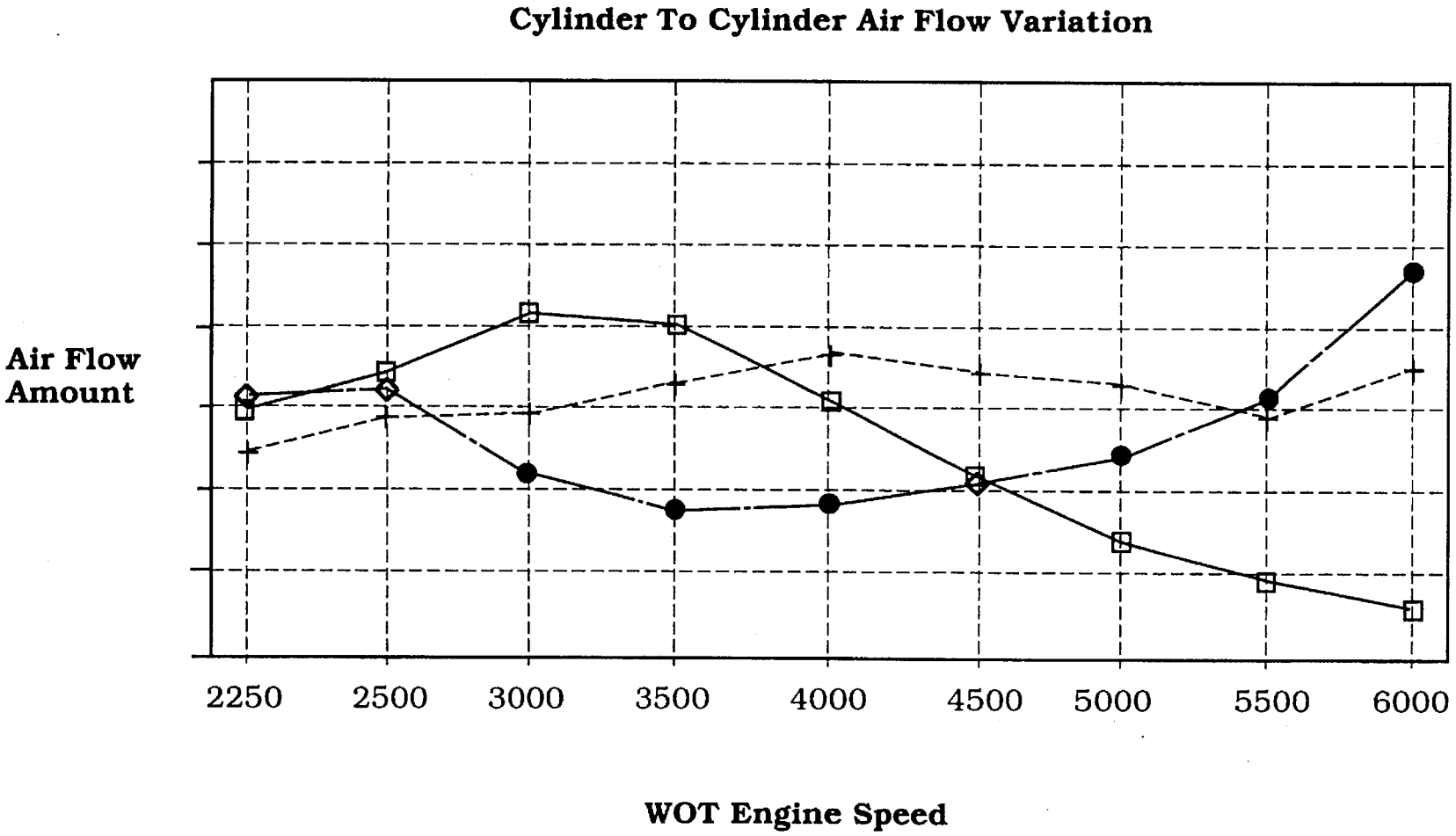
FIG. 5 is a graphical view showing the cylinder-to-cylinder air flow variations measured at wide open throttle conditions and at various engine speeds to provide the adjustment correction for the non-measured cylinders.
Figure 6:
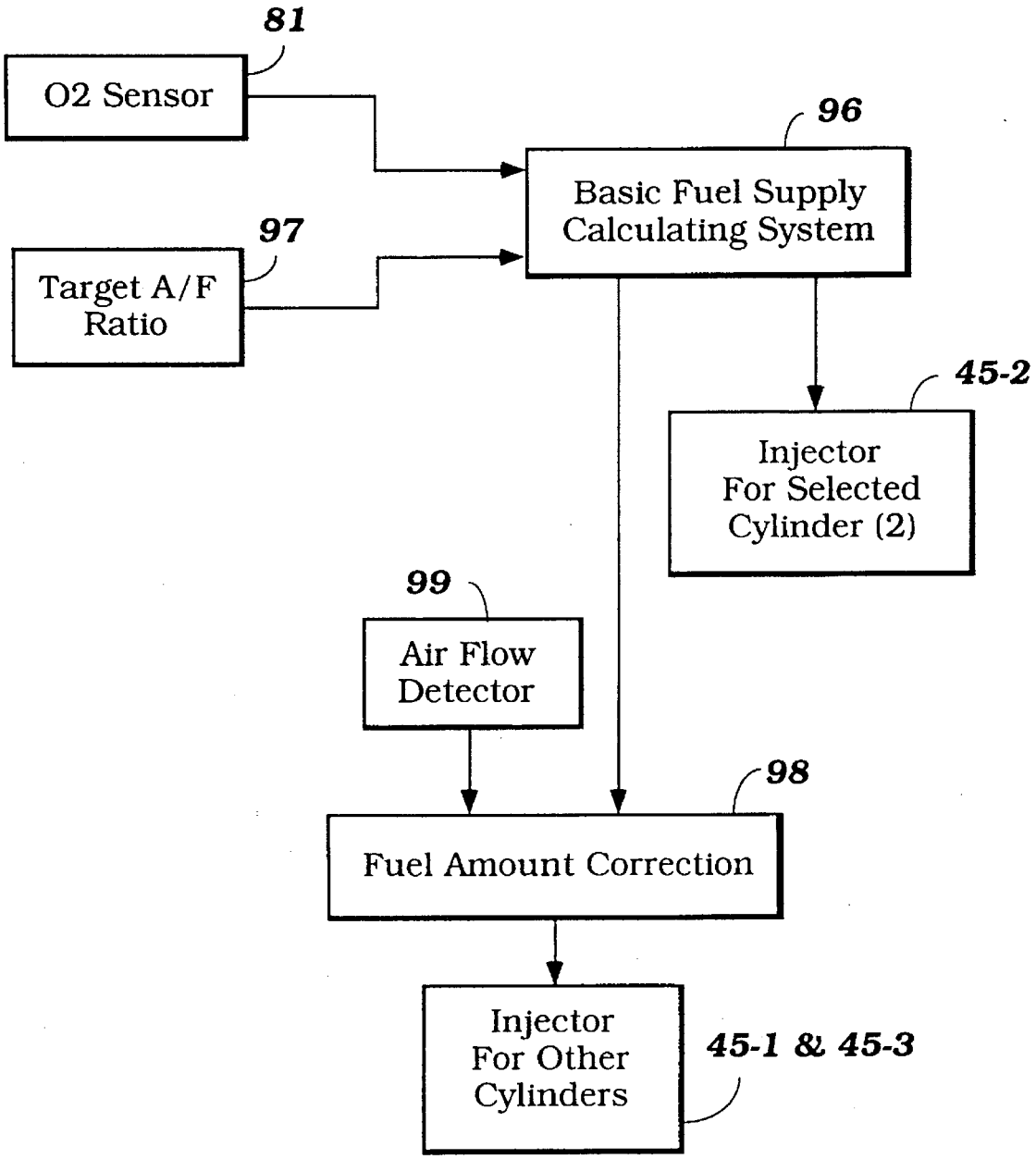
FIG. 6 is a block diagram showing the components and strategy for controlling the flow to the individual cylinders from the output of the sensor at one cylinder.

Basically, the way the system operates is that the feedback control for the cylinder that communicates with the sensor 81 is maintained in direct relationship to the output of the sensor. The remaining two cylinders have their control adjusted in response to a correction amount which is determined from measured cylinder-to-cylinder variations at various engine speeds and when operating under wide open throttle. FIG. 5 is a graphical view derived from measured data and shows that not only is there a deviation in the air flows to the individual cylinders at varying speeds in relation to total air flow but also the cylinder-to-cylinder variation is not uniform at varying flow amounts. Therefore, a map is programmed into the ECU 66 representative of the conditions of FIG. 5 so as to arrive at an air flow correction amount in relation to total air flow for cylinder-to-cylinder based upon variations from the sensed cylinder, cylinder 2 in this instance. Therefore, the ECU operates along a control routine as may be understood by reference to FIG. 6 which figure indicates the components of the system for achieving this correction in a manner in which the correction is actually implemented.

The ECU has a basic fuel supply calculating system, indicated generally by the reference numeral 96 which receives an output signal from the oxygen sensor 81 and also a target fuel/air ratio signal from a component of the ECU indicated by the reference numeral 97. This basically selects the desired air/fuel ratio for given engine conditions in accordance with any known strategy.

From this information, the basic fuel supply calculating system outputs a signal to the selected cylinder or the cylinder where the sensor 81 reads, this being the injector 45-2 in the example shown. There is no correction made for this cylinder. The basic fuel supply signal from the system 96 also is outputted to a fuel amount correction unit of the ECU which is indicated by the reference numeral 98 in FIG. 6. This also receives a signal from the air flow detector, indicated by the reference numeral 99. As has been previously noted, air flow can be calculated from crankcase pressure at a given time in the crankshaft rotation. Alternatively, a mass air flow meter may be incorporated in the induction system for the engine.

Having these signals, the fuel amount correction factor looks at a map like the map of FIG. 5 and provides a correction in the amount of fuel supplied to the remaining cylinders. If desired, these cylinders may also be maintained at a different fuel/air ratio than the basic cylinder as this may also be desirable due to the vertical orientation of the cylinders and the difference in positions between their exhaust ports 67 and the ends of the exhaust pipe 72. For example these cylinders may operate with a richer mixture than cylinder No. 2.

Thus, it should be readily apparent from the foregoing description that the described embodiment provides a very effective feedback control system for a multiple cylinder engine and requires only a single sensor that is associated with one cylinder of the engine. Of course, the foregoing description is that of a preferred embodiment of the invention and various changes and modifications may be made without departing from the spirit and scope of the invention, as defined by the appended claims.

We claim:

1. An internal combustion engine having a plurality of combustion chambers, a charge-forming and induction system for supplying a fuel/air charge to each of said combustion chambers, an exhaust system for collecting the combustion products from said combustion chambers and discharging them to the atmosphere, a combustion condition sensor cooperating with one of said combustion chambers for sensing the combustion condition therein, a feedback control system for controlling the amount of fuel supplied by said charge-forming system to said one combustion chamber from the output of said combustion condition sensor, means for measuring the total air flow to said engine, and means for providing a corrective factor from the total air flow to represent the anticipated air flow to the remaining combustion chambers, and means for adjusting the signal from said feedback control to compensate for the combustion chamber to combustion chamber variations and for controlling the supply of fuel to the remaining combustion chambers by said charge-forming system.

2. An internal combustion engine as set forth in claim 1, wherein the combustion condition sensor senses the combustion products directly from the combustion chamber.

3. An internal combustion engine as set forth in claim 2, wherein the engine operates on a two-stroke crankcase compression principle and the combustion products are sensed by communicating the combustion chamber sensor with the combustion chamber through a port juxtaposed to open at approximately the same time as the engine exhaust port opens.

4. An internal combustion engine as set forth in claim 3, wherein the combustion product sensor is positioned in a conduit interconnecting the port with a port in another combustion chamber operating on a different cycle for maintaining a constant flow of combustion products to the combustion condition sensor on each cycle of operation of the first-mentioned combustion chamber.

5. An internal combustion engine as set forth in claim 1, wherein the combustion chamber to combustion chamber air flow variations are determined from measurements made under the actual conditions.

6. An internal combustion engine as set forth in claim 5, wherein the combustion condition sensor senses the combustion products directly from the combustion chamber.

7. An internal combustion engine as set forth in claim 6, wherein the engine operates on a two-stroke crankcase compression principle and the combustion products are sensed by communicating the combustion chamber sensor with the combustion chamber through a port juxtaposed to open at approximately the same time as the engine exhaust port opens.

8. An internal combustion engine as set forth in claim 7, wherein the combustion product sensor is positioned in a conduit interconnecting the port with a port in another combustion chamber operating on a different cycle for maintaining a constant flow of combustion products to the combustion condition sensor on each cycle of operation of the first-mentioned combustion chamber.

9. A method for operating an internal combustion engine having a plurality of combustion chambers, a charge-forming and induction system for supplying a fuel/air charge to each of said combustion chambers, an exhaust system for collecting the combustion products from said combustion chambers and discharging them to the atmosphere, said method comprising the steps of sensing the combustion condition in only one of said combustion chambers controlling the amount of fuel supplied by said charge-forming system to said one combustion chamber from the sensed combustion condition, measuring the total air flow to said engine, and providing a corrective factor from the total air flow to represent the anticipated air flow to the remaining combustion chambers, and adjusting the signal from said feedback control to compensate for the combustion chamber to combustion chamber variations in the supply of fuel to the remaining combustion chambers by said charge-forming system.

10. A method as set forth in claim 9, wherein the combustion condition is sensed directly from the one combustion chamber.

11. A method as set forth in claim 10, wherein the engine operates on a two-stroke crankcase compression principle and the combustion products are sensed by communicating a combustion chamber sensor with the combustion chamber through a port juxtaposed to open at approximately the same time as the engine exhaust port opens.

12. A method as set forth in claim 11, wherein the combustion product sensor is positioned in a conduit interconnecting the port with a port in another combustion chamber operating on a different cycle for maintaining a constant flow of combustion products to the combustion condition sensor on each cycle of operation of the first-mentioned combustion chamber.

* * * * *